United States Patent [19]

Olsen

[11] Patent Number: 5,030,335

[45] Date of Patent: Jul. 9, 1991

[54] ARRANGEMENT FOR GAS COLLECTION IN ALUMINIUM REDUCTION CELLS HAVING SELF BAKING

[75] Inventor: Arnt T. Olsen, Borhaug, Norway

[73] Assignee: Elkem Aluminium ANS, Norway

[21] Appl. No.: 511,195

[22] Filed: Apr. 20, 1990

[30] Foreign Application Priority Data

May 24, 1989 [NO] Norway ..... 892073

[51] Int. Cl.[5] ..... C25C 7/00

[52] U.S. Cl. ..... 204/243 R; 204/245; 373/71; 373/73

[58] Field of Search ..... 204/243 R, 245; 373/71, 373/73

[56] References Cited

U.S. PATENT DOCUMENTS 3,935,090 1/1976 Petrusento et al. ..... 204/243 R

FOREIGN PATENT DOCUMENTS 0258608 7/1969 U.S.S.R. .

1468973 3/1989 U.S.S.R. .

2029449 3/1980 United Kingdom ..... 204/243 R

*Primary Examiner*—John F. Niebling

*Assistant Examiner*—Kathryn Gorgos

*Attorney, Agent, or Firm*—Lucas & Just

[57] ABSTRACT

The present invention relates to an arrangement for gas collection in electrolytic aluminium reduction furnaces equipped with Soderberg anode. The arrangement comprises a plurality of liftable cover plates 8–11 which cover the complete area between the sidewalls of the furnace and the anode casing 2. The cover plates 8–11 are gas tight sealed against the circumference of the anode casing 2 and against the furnace sidewalls 7. The cover plates 8–11 are on their upper side equipped with a plurality of ribs 12. A channel 13 comprising of a lower plate 14, and inclined plate 15 and an upper plate 16 is inserted in recesses in the ribs 12.

10 Claims, 5 Drawing Sheets

FIG. I.

ARRANGEMENT FOR GAS COLLECTION IN ALUMINIUM REDUCTION CELLS HAVING SELF BAKING

The present invention relates to an arrangement for gas collection in furnaces for electrolytic production of aluminium, which furnaces are equipped with Soderberg selfbaking carbon anodes where electric current is supplied to the anode by means of vertical contact bolts which also are holding the weight of the anode. Such furnaces are equipped with a permanent iron casing through which the anode is gradually slipped through at a rate corresponding to the rate which the anode is consumed during the electrolysis process.

BACKGROUND OF THE INVENTION

In furnaces of the above type, the furnace gases are usually collecting under a gas shirt which surrounds the Soderberg anode. The gas shirt is connected to the lower part of the casing and the lower part of the gas shirt extends down to about 5–10 cm above the level of the electrolytic bath. When a solid crust of electrolyte has been formed on the top of the bath, sealing between the lower end of the gas shirt and the crust is obtaining by addition of aluminium oxide on the top of the crust. From the gas shirt, the gas is usually forwarded to a burner where the content of CO in the gas is combusted to $CO_2$ by the supply of air.

In furnaces equipped with Soderberg anodes, the furnace gas will contain volatiles of pitch which also will be combusted in the burner. From the burner, the combustion gas is forwarded to a gas cleaning unit where the gas is subjected to wet cleaning with water or with a solution which contains alkali or alkali earth compounds, or the gas is subjected to dry cleaning such as absorption on aluminium oxide. The purpose of the cleaning process is to remove dust and gaseous fluorine components from the gas in order to be able to let the gas into the atmosphere without harming the environment. The collected fluorine compounds can be cleaned and returned to the electrolytic furnace.

The above described arrangement for gas collection has a number of disadvantages and drawbacks. One of the disadvantages is that when the crust on the outside of the gas shirt from time to time has to be broken down in order to supply aluminium oxide to the bath, the gas shirt will be open to the atmosphere and furnace gases and dust will escape to the furnace building. If point feeding of aluminium oxide through the gas shirt is used, one will easily have a build-up of oxide under the gas shirt which will prevent the flow of gases in the gas channel under the gas shirt, and there will be a risk of increased gas pressure in the channel which may press the furnace gas out under the gass shirt and into the furnace building. Such a blockage of the gas channel can also happen due to splashing of molten electrolyte. In addition to increased gas pressure and leackage of gases to the furnace building, there may be an increased suction in other parts of the gas channel with the result that aluminium oxide fed by point feeders may be sucked out into the gas collection system. It is a time consuming job to clean a blocked gas channel, and in addition, this job is unpleasant due to the fluorine containing gas and heat stress.

Splashing of the electrolyte bath happens particularly often when the so-called anode effect occurs. The anode effect can be observed by an increase in the furnace voltage from about 5 V to 15–60 V. The reason for the occurance of the anode effect is a build-up of an insulating gas layer on the anode. This gas layer has to be removed in order to stop the anode effect. The strong increase in the voltage can, when an anode effect occurs, cause a partly melting of the side crust in the furnace resulting in an increased electrolytic bath level. The increased bath level together with splashing can result in that the electrolytic bath comes into contact with the gas shirt which strongly cases increased wear of the gas shirt resulting in iron contamination of the produced aluminium. In order to maintain a good environment in the furnace building, the gas shirt, therefore, has to be replaced every second or third year.

It has also been experienced that it is difficult to keep the flanges between each of the gas shirt sections sealed. Air can, therefore, be sucked in between the sections of the gas shirt resulting in combustion of the furnace gases under the gas shirt. This combustion causes an increased wear of the anode and thereby an increased consumption of anode paste.

It has further been found that the sealing obtained by supplying aluminium oxide in the area of the lower end of the gas shirt will not be entirely gas tight. In addition, it is necessary to break the crust in order to tap the produced metal and in order to inspect the anode. By conventional Soderberg operation the complete crust will have to be broken into at regular intervals, for example every second to fourth day in order to charge oxide. A new crust, therefore, has to be built up in order to obtain a sealing of the gas shirt. By point feeding of oxide, this regular breakage of the crust will not be necessary. It will, however, be difficult to close openings made in the crust for allowing tapping of metal etc, as the oxide will flow through such openings without forming a new crust which will block the openings. This causes a pollution of the environment and loss of fluorides which otherwise would have been collected in the gas collection system and returned to the furnace.

SUMMARY OF THE INVENTION

By the present invention there is provided an arrangement for gas collection in electrolytic aluminium furnaces equipped with Soderberg anodes where the gas shirt is eliminated and where the outlet of furnace gases is substantially reduced compared to the known state of art for this kind of aluminium furnaces.

Accordingly, the present invention relates to an arrangement for gas collection in electrolytic aluminium reduction furnaces equipped with Soderberg anodes, which arrangement comprises a plurality of liftable cover plates which cover the complete area between the circumference of the anode and the top of the furnace side walls, which cover plates are sealed against the anode casing and against the sidewalls of the furnace.

Preferably, there are arranged four cover plates, one for each of the four sidewalls of the furnace. Further embodiment of the present invention will be evident from the claims.

BRIEF DESCRIPTION OF THE DRAWINGS

The present invention will now be further described in connection with the accompanying drawings wherein.

In the figures, there is shown an electrolytic furnace for aluminium production equipped with a Soderberg anode 1 having an anode casing 2. The anode casing 2 shown on FIG. 1 has vertical recesses 3, 4 in which there are arranged point feeders 5, 6 for aluminium oxide. Between the anode casing 2 and the sidewalls 7 of the furnace there is arranged four cover plates 8–11 for closing the surface of the furnace. Even though FIG. 1 shows four cover plates, it should be appreciated that according to the present invention the number of cover plates can be more than four, for example six, eight or more. The cover plates are equipped with closable openings 28 which can be opened in order to tap metal from the furnace, and for inspection etc.

Due to the risk for gas leakages between adjacent cover plates, it is preferred to use four cover plates, one for each of the long sides, and one for each of the short sides of the electrolytic furnace.

The gas sealing between the cover plates 8–11 and the anode casing 2 and between the cover plates 8–11 and the furnace sidewalls 7 preferably consist of a layer of particulate material such as for example aluminium oxide.

The cover plates 8–11 will now be further described in connection with FIGS. 3 and 4.

Figure 3:
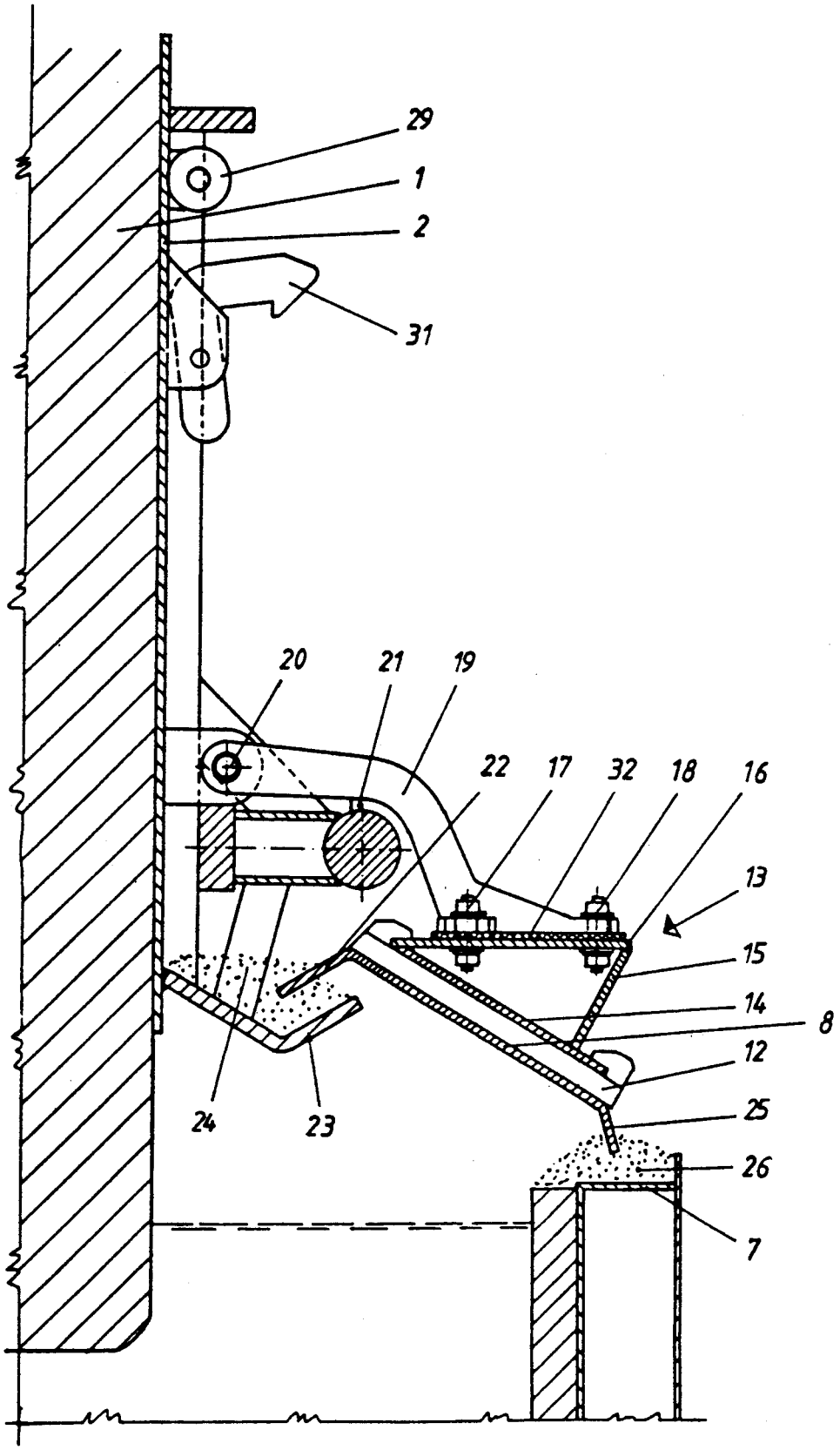
FIG. 3 is a vertical cut similar to FIG. 2 showing the cover plates in more details.
Figure 4:
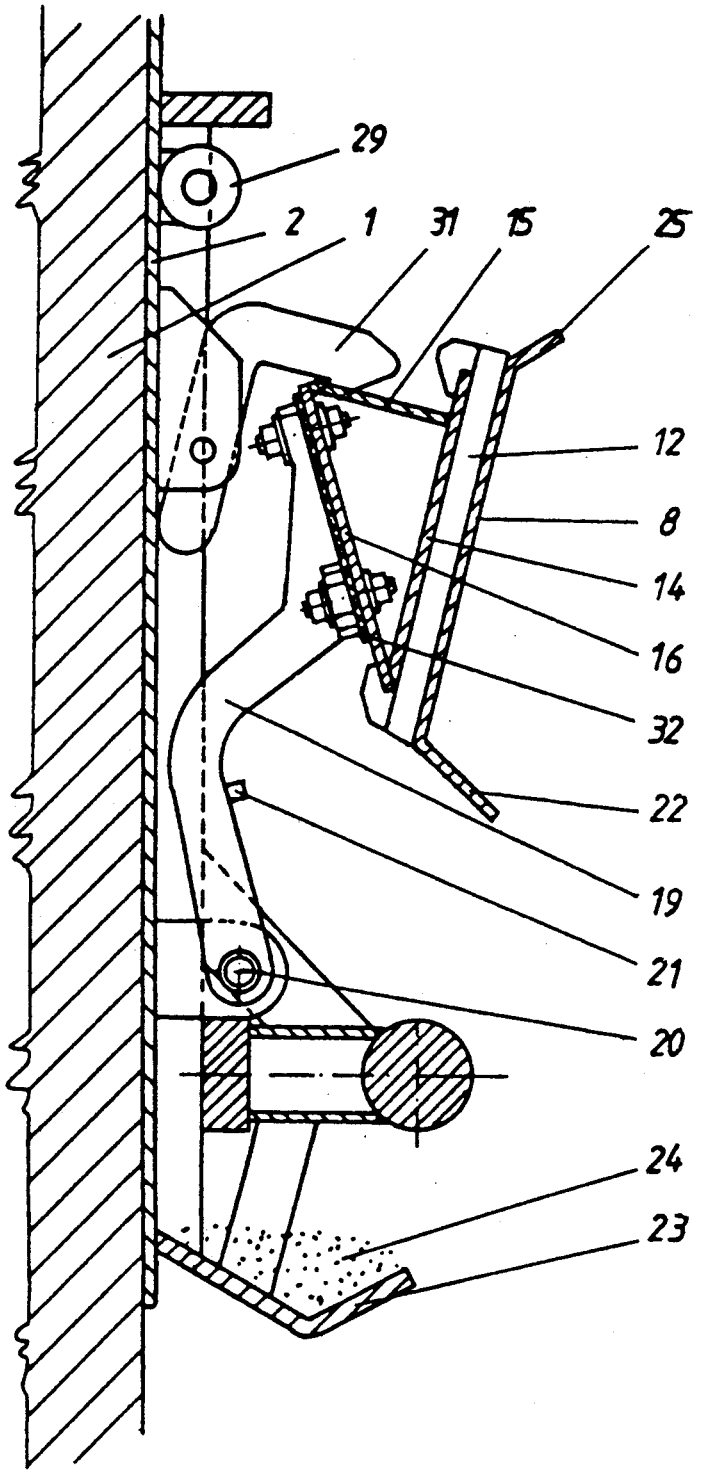
FIG. 4 shows the cover plates of FIG. 3 in lifted position, and where.
Figure 5:
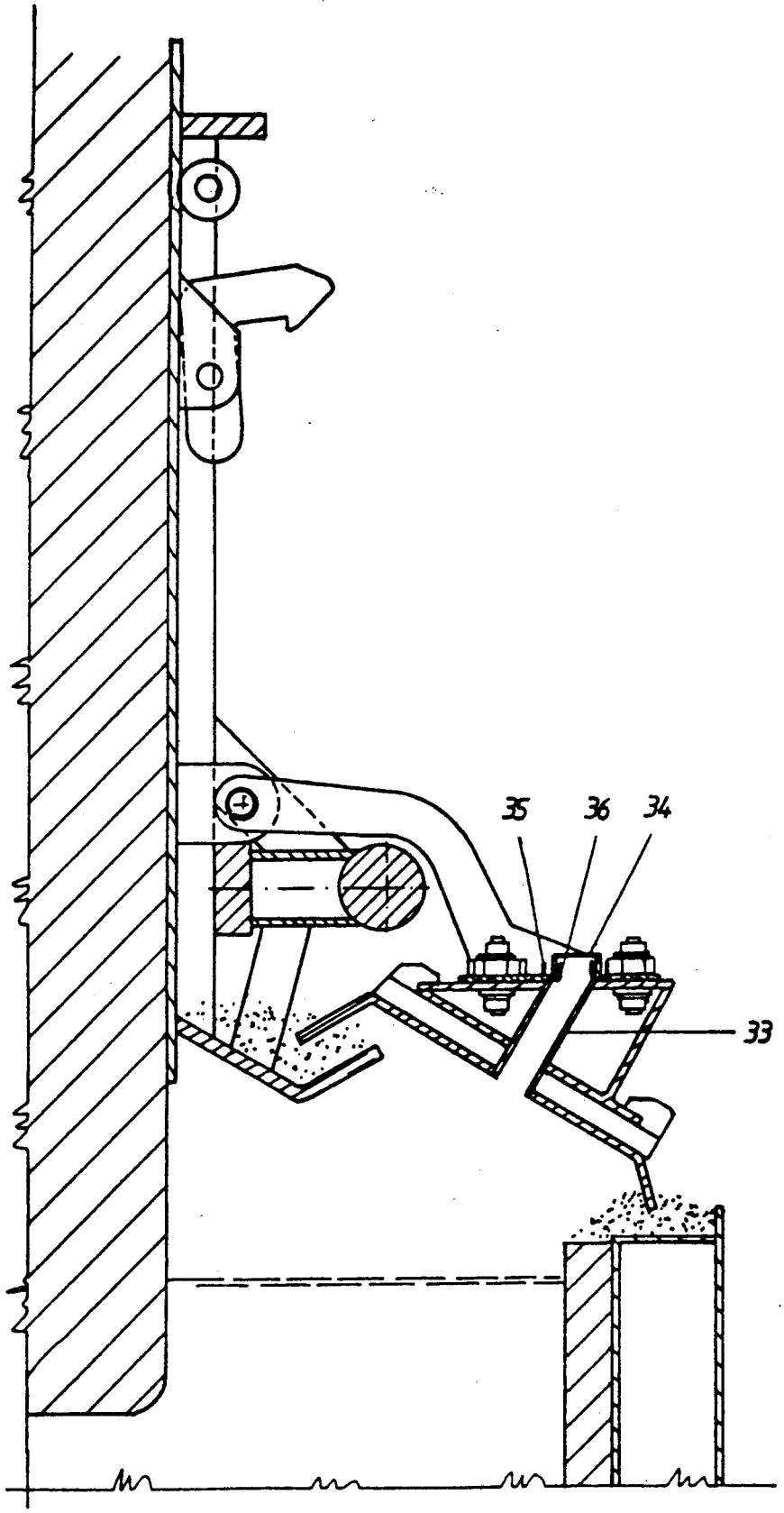
FIG. 5 shows a vertical cut through line II—II in FIG. 1.

In FIGS. 3 and 4, there are shown one cover plate 8. The cover plate 8 is preferably made from steel. To the top of the cover plate 8, there is welded a plurality of ribs 12 made from steel. An iron channel 13 is inserted into grooves in the ribs 12. The channel 13 is made from a lower plate 14, and inclined plate 15 and an upper plate 16. The lower plate 14 of the channel 13 is kept in place by means of the grooves in the ribs 12 and is dimensioned in order that the cover plate with the ribs 12 are allowed to expand without being stuck to the channel 13. The cover plate 8 is thus free to move relatively to the channel 13. Heat expansion of the cover plate 8 can, thus, take place freely and without causing substantial deformation of the cover plate 8. The channel 13 is lesser exposed to heat than the cover plate 8 and is more solidly designed, whereby the channel 13 forms a rigid profile which will prevent the cover plate 8 from being deformed due to the heat exposure. The closeable openings 28 in the cover plates 8–11 are shown in more details in FIG. 5. As shown in FIG. 5 the opening 28 comprises a pipe 33 which extends through the cover plate 8 and the lower and upper plates 14, 16 of the channel 13. The pipe 33 is normally closed by a lid 34 arranged in the annulus between two rings 35, 36 which are welded to the upper plate 16 of the channel 13. In order to obtain a good gas seal the annulus between the rings 35, 36 is filled with an electric insulating particulate material, preferably aluminium oxide. The pipe 33 also has the function of a fixed point between the channel 13 and the cover plate 8. To the upper plate 16 of the channel 13, there are bolts 17, 18 connected to a holding and lifting arm 19. The holding and lifting arm 19 is electrically insualted from the cover plate 8 by means of an insulating layer 32. The holding and lifting arm 19 is rotatably connected to the anode casing 2 at 20. The holding and lifting arm 19 is further equipped with a member 21 for limiting the lowering of the arm 19. In FIG. 3, the cover plates are shown in closed position, In this closed position the upper and inner end 22 of the cover plate 8 will be at a distance of 3–10 mm from a bracket 23 which is arranged about the circumference of the anode casing 2. The cover plate 8 is sealed against the anode casing 2 by filling aluminium oxide into the bracket 23 as shown at 24. In the closed position, the lower end 25 of the cover plate 8 will be in located about 3–10 mm above the top of the furnace sidewall 7. The cover plate 8 is sealed against the furnace sidewall 7 by means of a layer 26 of aluminium oxide. When all the cover plates 8–11 are in the position shown on FIG. 3, the surface of the furnace is effectively sealed against the atmosphere. The reaction gases which form during the electrolysis are sucked out through a gas outlet 27, and the gases are then combusted by supplying air, whereafter the gas is cleaned in a conventional way before it is released to the atmosphere.

Figure 1:
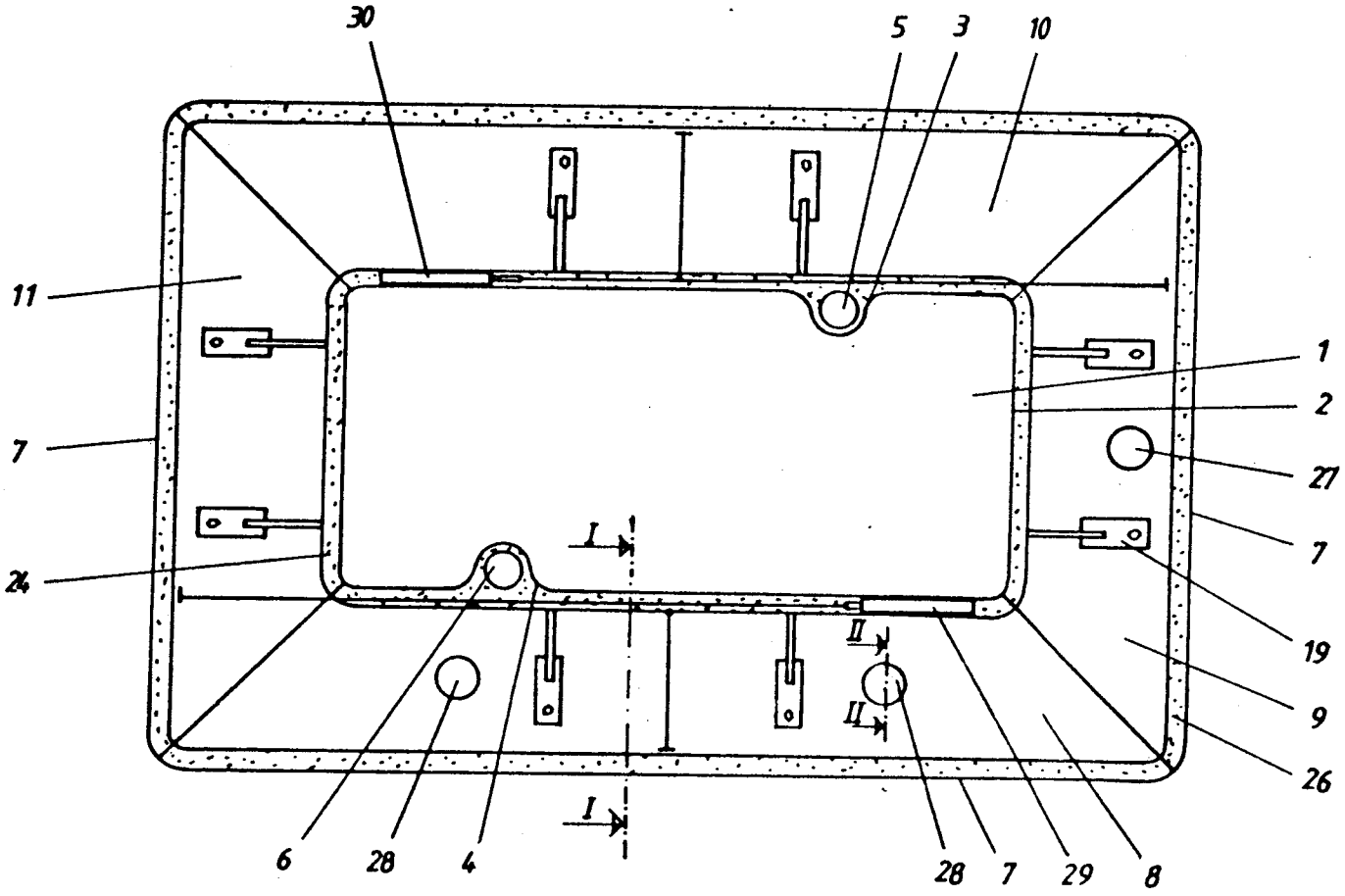
FIG. 1 shows a top view of an aluminium furnace equipped with a Soderberg anode having a gas collection arrangement according to the present invention.
Figure 2:
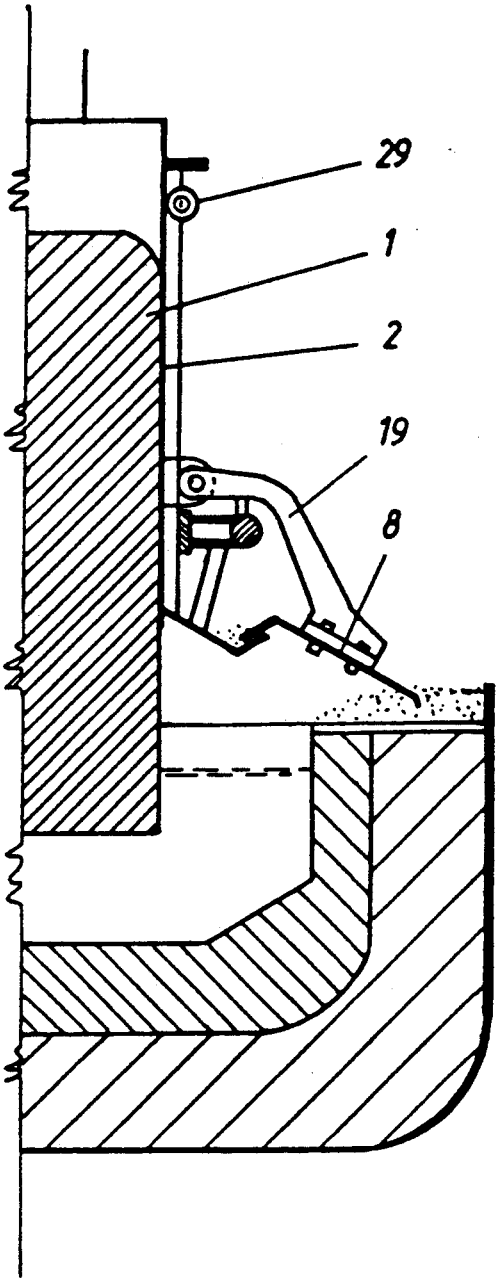
FIG. 2 shows a vertical cut through line I—I in FIG. 1.

During normal operation, the cover plates 8–11 are in the closed position. Tapping of the metal, inspection etc. are done through the closeable openings 28 in the cover plates 8–11. From time to time, it will, however, be necessary to open the cover plates in order to remove carbon particles etc. from the electrolytic bath. The cover plates 8–11 can then be lifted to an upper open position as shown in FIG. 4. The lifting is preferably done by means of hydraulic or pneumatic cylinders 29, 30 as shown in in FIG. 1. In order to lock the cover plates 8–11 in open position there is arranged a movable bracket 31 for engagement with an opening in the inclined plate 15 of the channel 13. The arrangement according to the present invention is compact and simple to operate. The lifetime for the cover plates are long as they are not directly exposed to the melt. Due to a large increased volume below the cover plates compared to the volume below conventional gas shirt, the risk of clogging is eliminated.

What is claimed:

1. A gas shirt for collecting gas from a furnace having a self-baking anode equipped with an anode casing, said gas shirt comprising a plurality of plate means for forming a gas tight seal between a side wall of the furnace and the anode casing, each such plate means comprising:

(a) a lift arm rotatably moveably attached at one end to said anode casing;

(b) a cover plate attached to the other end of said lift arm, said lift arm holds and lifts said cover plate;

(c) a first seal means for forming a gas tight seal between the anode casing and the cover plate, said first seal means attached to said anode casing; and (d) a second seal means for forming a gas tight seal between the side wall of the furnace and the cover plate.

2. The gas shirt of claim 1, characterized in that the cover plate is equipped with a plurality of ribs and that a channel comprising a lower plate, an inclined plate and an upper plate is inserted into recesses in the ribs.

3. The gas shirt of claim 2, characterized in that at least one lifting arm is connected to the upper plate of the channel.

4. The gas shirt of claim 3, characterized in that the lifting arm is electrically insulated from the channel by means of an insulating plate.

5. The gas shirt of claim 2, characterized in that the cover plate has a closeable opening therein and said closeable opening comprises a pipe which extends through the cover and the upper and lower plates of the channel.

6. The gas shirt of claim 5, characterized in that the closeable opening is equipped with a removable lid which is arranged between two concentric cylinders connected to the upper plate of the channel.

7. The gas shirt of claim 1, characterized in that pneumatic or hydraulic cylinders are affixed to the anode casing for lifting of the cover plate.

8. The gas shirt of claim 1, characterized in that the first sealing means for forming the gas tight seal between the anode casing and the cover plate comprises a particulate, electric insulating material arranged on a bracket.

9. The gas shirt of claim 1, characterized in that the second sealing means for forming a gas tight seal between the furnace side wall and the cover plate comprises a particulate, electric insulating material arranged on the top of the furnace side wall.

10. The gas shirt of claim 1, characterized in that the cover plate has a closeable opening.

* * * * *

UNITED STATES PATENT AND TRADEMARK OFFICE

CERTIFICATE OF CORRECTION

PATENT NO. : 5,030,335

DATED : July 9, 1991

INVENTOR(S) : Arnt T. Olsen

It is certified that error appears in the above-identified patent and that said Letters Patent is hereby corrected as shown below: Title page; Item (54) and column 1;

Amend the title to read --ARRANGEMENT FOR GAS COLLECTION IN ALUMINIUM REDUCTION CELLS HAVING SELF BAKING ELECTRODES--.

Column 1, line 55, change "gass" to --gas--.

Column 1, line 58, change "leackage" to --leakage--.

Column 2, line 2, change "occurance" to --occurrence--.

Column 2, line 6, change "partly" to --partial--.

Column 3, line 48, change "lesser" to --less--.

Column 4, line 4, change "," to --.--.

Column 4, line 10, delete "in".

Column 4, line 49, delete "moveably".

Signed and Sealed this

Twenty-fourth Day of November, 1992

*Attest:*

DOUGLAS B. COMER

*Attesting Officer*

*Acting Commissioner of Patents and Trademarks*